US006349630B1

(12) United States Patent
Wood

(10) Patent No.: US 6,349,630 B1
(45) Date of Patent: Feb. 26, 2002

(54) WOBBLE PISTON AND SEAL ASSEMBLY FOR OIL FREE COMPRESSOR

(75) Inventor: Mark Wood, Jackson, TN (US)

(73) Assignee: DeVilbiss Air Power Company, Jackson, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/708,850

(22) Filed: Nov. 8, 2000

Related U.S. Application Data

(63) Continuation of application No. 09/273,585, filed on Mar. 22, 1999.

(51) Int. Cl.[7] ..... F16J 9/00
(52) U.S. Cl. ..... 92/240; 92/241; 92/245
(58) Field of Search ..... 92/194, 240, 241, 92/245

(56) References Cited

U.S. PATENT DOCUMENTS 1,751,445 A * 3/1930 Davis ..... 92/240
6,213,000 B1 * 4/2001 Wood ..... 92/240

* cited by examiner

*Primary Examiner*—Edward K. Look
*Assistant Examiner*—Thomas Lazo
(74) *Attorney, Agent, or Firm*—Suiter & Associates PC; William J. Breen, III

(57) ABSTRACT

The present invention is directed to a wobble piston and seal assembly for an oil free compressor. An upwardly directed curvature is provided on a piston surface which supports the seal. The curvature is located adjacent the perimeter of the surface to impart a slight dish shape to the surface. Preferably, the curvature has the same radius as the bend radius of the seal when the piston head is inserted into a cylinder. When the seal is initially clamped to the support surface, the seal is formed to take on the curvature of the support surface. Consequently, the seal is preformed into a shallow cup shape prior to final forming when the piston and seal assembly are inserted into a cylinder.

25 Claims, 3 Drawing Sheets

WOBBLE PISTON AND SEAL ASSEMBLY FOR OIL FREE COMPRESSOR

CROSS REFERENCE TO RELATED APPLICATION

The present invention is a Continuation of U.S. patent application Ser. No. 09/273,585 filed Mar. 22, 1999, said U.S. Patent Application is herein incorporated by reference in its entirety. The present application also incorporates U.S. patent application Ser. No. 09/247,705, filed Feb. 9, 1999 by reference in its entirety.

FIELD OF THE INVENTION

The present invention generally relates to the field of compressors, and particularly to a wobble piston and seal assembly for an oil free compressor.

BACKGROUND OF THE INVENTION

One type of compressor for air and other gases is referred to as an oil free compressor. This is a reciprocating compressor in which lubricating oil is not required between a piston head and the adjacent walls of a cylinder in which the piston head is reciprocated. In an oil-lubricated compressor, the piston head is sized to only reciprocate in the cylinder. A connecting rod is connected to the piston head with a wrist pin which permits the piston head and connecting rod to rotate relative to each other. During operation of the compressor, oil is splashed or pumped from a sump onto the walls of the cylinder and onto bearing surfaces between the wrist pin and the connecting rod. At least one piston ring seal is provided in an annular groove around the perimeter of the piston to maintain a gas tight seal which prevents leakage of the compressed gas from a compression chamber and prevents most of the lubricating oil from flowing past the piston ring seals to the compression chamber. However, a small amount of lubricating oil may flow past the seal and into the compression chamber and contaminate the compressed gas.

In one common type of oil free compressor, the piston head is formed integrally with the connecting rod so that they do not rotate relative to each other. Since a driven end of the connecting rod is moved about a circle by an eccentric or a crank pin, the piston head will rock or wobble as it is reciprocated in a cylinder. The piston head is relatively thin and sufficient clearance must be provided between the piston head and the cylinder walls to allow the piston head to wobble. Because of the wobble or rocking motion of the reciprocating piston, greater demands are placed on a seal which must extend between the piston head and the cylinder walls. The seal is generally cup shaped when inserted into the cylinder and is formed from a resilient, low friction material which will press against and slide along the cylinder walls as the piston head wobbles during reciprocation.

One method used for forming a cup shaped seal on a wobble piston has been to clamp a flat ring or washer shaped piece of seal material to a flat surface on the piston head. The piston head and attached seal ring are forced into a cylinder. As the piston head enters the cylinder, the seal forms a 90° bend next to the cylinder wall to impart a cup shape to the seal. The fibers in the seal at the outside of the bend become highly strained as they are bent 90°, weakening the seal. In order to reduce the strain in the seal at the bend, the seal was formed from a softer material than otherwise would be preferred. The softer material is subject to greater wear and consequently has a shorter operating life than may be achieved with a harder seal material.

When the seal is bent into the cup shape, the region of the seal adjacent the bend tends to separate or pull away from the adjacent flat surface on the piston head. Consequently, the seal is not supported adjacent the bend. As the cylinder pressure increases during each cycle of compressor operation, the seal is forced downwardly toward the flat piston head surface, causing the cup bend radius to decrease. The smaller cup radius of the seal increases bending stress on the seal. Since the cylinder pressure varies over each stroke of the piston, the resultant seal bending stress is cyclic. At higher pressures, the unsupported portion of the seal in the region of the bend is forced towards the flat piston head surface, subjecting the seal material to bending fatigue and possible premature fatigue failure. While this problem may occur in a single stage compressor at moderate pressures, it is even more critical in a second stage high pressure cylinder of a two stage oil free compressor. Premature seal failure in the second stage has been an impediment to a successful, commercial two stage oil free wobble piston air compressor.

SUMMARY OF THE INVENTION

Accordingly, the present invention is directed to a wobble piston and seal assembly for an oil free compressor. An upwardly directed curvature is provided on a piston surface which supports the seal. The curvature is located adjacent the perimeter of the surface to impart a slight dish shape to the surface. Preferably, the curvature has the same radius as the bend radius of the seal when the piston head is inserted into a cylinder. When the flat annular seal is initially clamped to the support surface, the seal is formed to take on the curvature of the support surface. Consequently, the seal is preformed into a shallow cup shape prior to final forming when the piston and seal assembly are inserted into a cylinder.

When the piston and seal assembly are inserted into a cylinder, the seal is bent 90° from a plane through the piston head to form a cup shape. The lower surface of the seal remains in contact with and supported by the support surface on the piston head. Consequently, when the seal is subjected to high pressure during operation in a compressor, there is less flexing at the 90° bend radius on the seal due to the fact that the seal is supported by the curved top surface on the piston. When the piston head is subjected to high compressed gas pressure, the bend radius does not significantly change. This reduced the risk of fatigue failure of the seal. Further, since there is no significant reduction in the bend radius during operation of the compressor, there is less stress in the seal at the outside of the bend at high pressures. The reduced stress permits using a harder, more durable material for forming the seal.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying Figures in which.

DETAILED DESCRIPTION OF THE INVENTION

Reference will now be made in detail to the presently preferred embodiments of the invention, examples of which are illustrated in the accompanying drawings.

Figure 1:
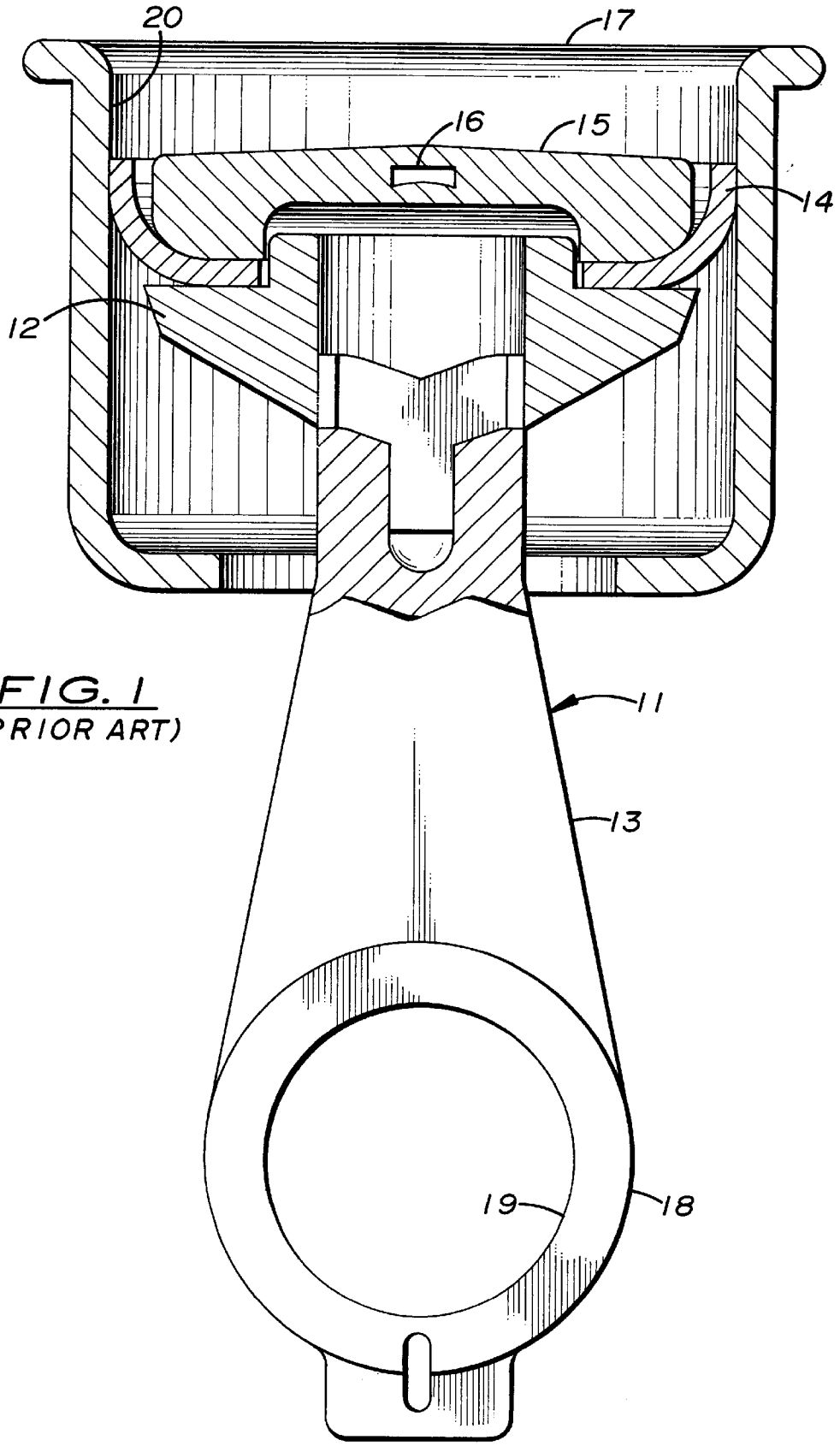
FIG. 1 (PRIOR ART)
FIG. 1 is a cross sectional view through a wobble piston according to the prior art.

Referring to FIG. 1 of the drawings, a cross sectional view is shown of a prior art wobble piston and seal assembly 10 for use in an oil free air compressor (not shown). The assembly 10 includes a wobble piston 11 having a head 12 and a connecting rod 13 formed as an integral unit. As used herein, "integral" is used to mean that the piston head 12 and the connecting rod 13 do not pivot or rotate relative to each other. The piston head 12 includes a plate 15 which is secured with a screw 16 for attaching a seal 14 to the piston head 12. The assembly 10 is shown with the piston head 12 positioned within a cylinder 17. The connecting rod 13 has a lower end 18 opposite the end attached to the head 12. An opening 19 is formed in the connecting rod end 18 for pivotal attachment to either an eccentric, such as a crank pin on a crank shaft (not shown). As the eccentric is rotated, the piston head 12 will reciprocate and rock or wobble in the cylinder 17. The area within the cylinder 17 above the piston head 12 forms a compression chamber wherein gas is compressed on upward strokes of the piston head 12.

Figure 2:
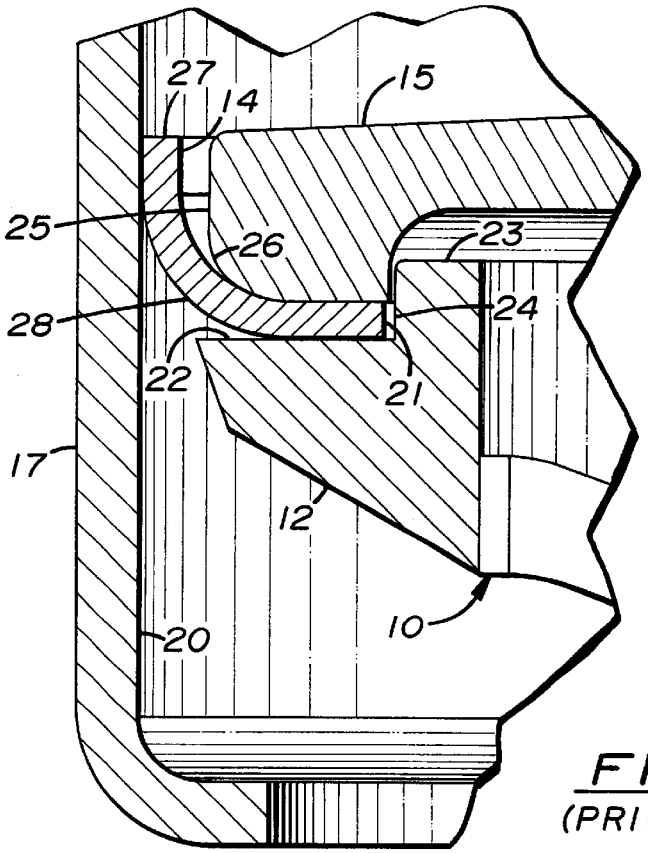
FIG. 2 (PRIOR ART)
FIG. 2 is an enlarged fragmentary cross sectional view as taken along line 2—2 of FIG. 1.

FIG. 2 is an enlarged fragmentary cross sectional view showing the seal 14, its connection to the piston head 12, and an adjacent portion of an interior wall 20 of the cylinder 17. Prior to inserting the piston head 12 into the cylinder 17, the seal 14 is a flat ring having an interior opening 21. The piston head 12 has an annular flat top surface 22 against which the seal 14 is placed. Preferably, an annular flange 23 projects upwardly from the surface 22. The flange 23 extends through the seal opening 21 to position the seal 14 on the piston head 12. The plate 15 has a lower annular surface 24 which fits over the flange 23. When the screw 16 (FIG. 1) is secured, the seal is clamped between the annular surface 24 and the flat piston head surface 22. The plate 15 also has a perimeter 25 which is connected by a curved corner 26 to the lower surface 24. As best seen in FIG. 2, there is a sufficient clearance between the cylinder wall 20 and the piston head 12 and the perimeter 25 of the attached plate 15 to provide for the seal 14 and to permit the piston head 12 to wobble or rock as it is reciprocated in the cylinder 17.

After the flat seal 14 is clamped to the piston head 12, it is formed into a cup shape by forcing the piston head 12 into the cylinder 17. As the piston head 12 enters the cylinder 17, an outer end 27 of the seal 14 is bent upwardly to form substantially a 90° bend 28 to the seal and to impart a cup shape to the seal. The bend is described as "substantially" 90° since the actual angle of the bend around the piston head will vary with any tilt of the piston head 12 relative to the axis of the cylinder 17. When the plane of the piston head 12 is perpendicular to the axis of the cylinder 17, the angle of the seal bend 28 will be 90° around the piston head 12. When the piston head 12 is tilted in the cylinder 17, the angle of the bend 28 on one side of the piston head 12 will be greater than 90° and the angle of the bend 28 on a diametrically opposite side of the piston head 12 will be less than 90°. The actual angle of the bend 28 at any location around the piston head 12 will depend on the amount of tilt and the to direction of the tilt. However, the average angle of the bend 28 will be 90°. The seal end 27 is maintained in contact with the cylinder wall 20 as the piston head 12 reciprocates and wobbles due to the resilience of the seal and due to air pressure pressing on the seal. As is shown in FIG. 2, the seal 14 lifts away from the flat piston head surface 22 in the region of the bend 28. During operation of a compressor in which the piston and seal assembly 10 is installed, higher air pressures will tend to force the seal bend 28 towards the flat piston head surface 22. Consequently, the radius of the bend 28 decreases at high pressure. This produces high stresses in the seal in the region of the bend 28. A sufficiently soft material must be used to form the seal 14 in order to prevent seal failure at the bend. However, the softer material may be subject to greater abrasion due to friction with the cylinder wall 20 than a harder material.

Figure 3:
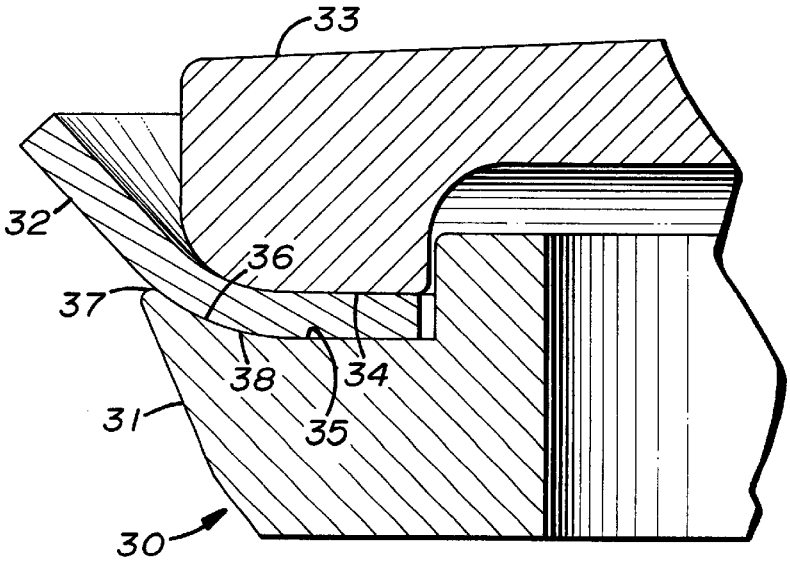
FIG. 3 is an enlarged fragmentary cross sectional view of a corner of a piston head in a wobble piston assembly according to the invention with the seal attached prior to shaping the seal into a cup shape.
Figure 4:
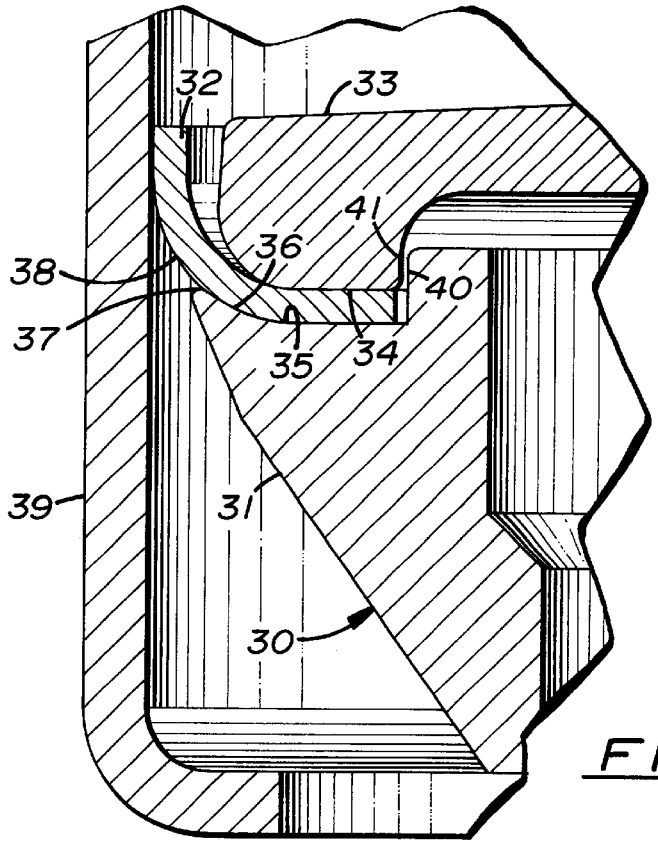
FIG. 4 is an enlarged fragmentary cross sectional view, similar to FIG. 2, showing details of an improved wobble piston and seal assembly according to the invention.

FIGS. 3 and 4 show a fragmentary portion of a wobble piston and seal assembly 30 according to a preferred embodiment of the invention. The illustrated portion of the piston and seal assembly 30 is similar to that shown in FIG. 2. The remaining portions of the wobble piston and seal assembly 30 are of conventional design. The assembly 30 includes a piston head 31 and a seal 32. The piston head includes a seal retaining plate 33 which is secured to the piston head 31 with, for example, a screw (not shown). The seal 32 is clamped between an annular lower surface 34 on the plate 33 and an annular seal support surface 35 on the piston head 31. Unlike the prior art piston 11 of FIGS. 1 and 2, the seal support surface 35 on the piston 34 has an upwardly curved portion 36 adjacent an outer perimeter 37 of the piston head 31. Consequently, when a flat annular seal 32 is clamped to the piston head 31, a partial curve or bend 38 is imparted to the seal 32 by the curved surface portion 36. At this stage, the bend 38 is substantially less than 90°. This pre-shaping of the seal 32 before the piston head 31 is inserted into a cylinder 39 provides several advantages over the prior art. As the piston head 31 is inserted into the cylinder 39 and the bend 38 is formed to substantially 90°, the seal 31 is not lifted away from the support surface 35, as it is lifted from the flat surface 22 in the prior art piston 11. The seal 32 continues to be supported by the support surface 35 up to the perimeter 37 of the piston head 31. Consequently, the radius of the bend 38 does not significantly decrease when the seal 32 is subjected to high pressure compressed air during operation of the assembly 30 in an air compressor. Since the seal is not subjected to the degree of fatigue as with prior art wobble piston and seal assemblies, the seal will have a longer operating life. Further, since there is a greater bend radius of the seal at the bend 38 at higher air pressures, the seal will have lower internal stresses than the prior art seal. This permits forming the seal from a harder material, which further increases the operating life of the seal.

Figure 5:
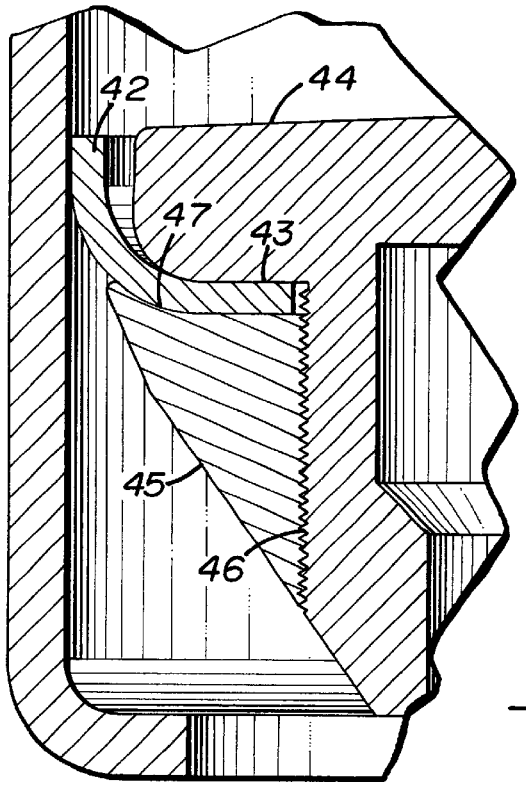
FIG. 5 is an enlarged fragmentary cross sectional view, similar to FIG. 4, showing details of a wobble piston and seal assembly according to a further embodiment of the invention.

FIG. 4 shows and describes a preferred piston construction with a specific way of securing the seal 32 to the piston head 31 using a plate 33 secured with a screw to the top of the piston head 31. It will be appreciated that other means may be used for mounting the seal 32 on the piston head. For example, the plate 33 may be threaded to engage the top of the piston head 31 without the need for a separate screw. Alternately, as shown in FIG. 5, a seal 42 may be secured to a lower surface 43 on a piston head 44 with an annular member 45 which is secured to the piston head 44 with threads 46. The annular member 45 has a curved seal support surface 47 similar to the seal support surface 35 with the curve 36. However, the piston may be stronger if the seal support surface is integral with the connecting rod as in FIG. 4, where threads 46 are not required to take the load from the compressed air acting on the seal.

It is believed that the wobble piston and seal assembly for oil free compressor of the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A wobble piston suitable for use in a compressor, comprising:

a piston head including a seal support surface, the seal support surface having a curvature located adjacent to a perimeter of the seal support surface;

a seal disposed on the seal support surface; and a seal retaining plate suitable for mounting the seal to the piston head, wherein when the seal retaining plate mounts the seal to the piston head, the seal support surface causes the seal to correspond generally to the curvature of the seal support surface.

2. The wobble piston as described in claim 1, wherein the curvature has a radius corresponding to a bend radius of the seal when the wobble piston is inserted into a cylinder.

3. The wobble piston as described in claim 1, wherein the curvature of the seal support surface is less than 90 degrees.

4. The wobble piston as described in claim 1, wherein the curvature of the seal support surface imparts a cup shape to the seal.

5. The wobble piston as described in claim 4, wherein the cup shape is imparted prior to being inserted into a cylinder.

6. The wobble piston as described in claim 1, wherein the curvature of the seal support surface enables the seal to remain in contact with the perimeter of the piston head when the wobble piston is inserted into a cylinder.

7. The wobble piston as described in claim 1, wherein the curvature of the seal support surface is suitable for supporting the seal when the seal is under pressure so that the seal remains at generally a same bend radius under pressure as when the seal is not under pressure.

8. The wobble piston as described in claim 1, wherein the seal has a maximum diameter greater than a diameter of the piston head.

9. The wobble piston as described in claim 1, further comprising a connecting rod integrally formed with the wobble piston.

10. An apparatus, comprising:

a wobble piston, including a piston head including a seal support surface, the seal support surface having a curvature located adjacent to a perimeter of the seal support surface; and a seal mounted to the seal support surface, wherein the seal support surface causes the seal to correspond generally to the curvature of the seal support surface so as to impart a cup shape to the seal.

11. The apparatus as described in claim 10, wherein the cup shape is imparted prior to being inserted into a cylinder.

12. The apparatus as described in claim 10, wherein the curvature of the seal support surface enables the seal to remain in contact with the perimeter of the piston head when the wobble piston is inserted into a cylinder.

13. The apparatus as described in claim 10, wherein the curvature has a radius corresponding to a bend radius of the seal when the wobble piston is inserted into a cylinder.

14. The apparatus as described in claim 10, wherein the curvature of the seal support surface is less than 90 degrees.

15. The apparatus as described in claim 10, wherein the curvature of the seal support surface is suitable for supporting the seal when the seal is under pressure so that the seal remains at generally a same bend radius under pressure as when the seal is not under pressure.

16. The apparatus as described in claim 10, wherein the seal has a maximum diameter greater than a diameter of the piston head.

17. The apparatus as described in claim 10, further comprising a connecting rod integrally formed with the wobble piston.

18. A compressor assembly including a wobble piston, comprising:

a cylinder suitable for receiving a wobble piston; and a wobble piston, including a piston head including a seal support surface, the seal support surface having a curvature located adjacent to a perimeter of the seal support surface; and a seal mounted to the seal support surface, wherein the seal support surface causes the seal to correspond generally to the curvature of the seal support surface wherein the curvature of the seal support surface enables the seal to remain in contact with the perimeter of the piston head when the wobble piston is inserted into the cylinder.

19. The compressor assembly as described in claim 18, wherein the curvature has a radius corresponding to a bend radius of the seal when the wobble piston is inserted into the cylinder.

20. The compressor assembly as described in claim 18, wherein the curvature of the seal support surface is less than 90 degrees.

21. The compressor assembly as described in claim 18, wherein the curvature of the seal support surface imparts a cup shape to the seal.

22. The compressor assembly as described in claim 21, wherein the cup shape is imparted prior to being inserted into a cylinder.

23. The compressor assembly as described in claim 18, wherein the curvature of the seal support surface is suitable for supporting the seal when the seal is under pressure so that the seal remains at generally a same bend radius under pressure as when the seal is not under pressure.

24. The compressor assembly as described in claim 18, wherein the seal has a maximum diameter greater than a diameter of the piston head.

25. The compressor assembly as described in claim 18, further comprising a connecting rod integrally formed with the wobble piston.

* * * * *